United States Patent [19]

Schupp

[11] 3,972,673

[45] Aug. 3, 1976

[54] PHOTOFLASH LAMP

[75] Inventor: Lewis J. Schupp, Chesterland, Ohio

[73] Assignee: General Electric Company, Schenectady, N.Y.

[22] Filed: Sept. 23, 1974

[21] Appl. No.: 508,107

[52] U.S. Cl. ..... 431/95 R; 149/40
[51] Int. Cl.[2] ..... F21K 5/02
[58] Field of Search ..... 149/37, 40; 431/93–95

[56] References Cited

UNITED STATES PATENTS

| | | | |
|---|---|---|---|
| 2,791,111 | 5/1957 | Gleim | 431/95 |
| 2,982,119 | 5/1961 | Anderson | 431/95 |
| 3,028,229 | 4/1962 | Olander | 149/40 |
| 3,111,016 | 11/1963 | Fink et al. | 431/95 |
| 3,501,254 | 3/1970 | Nijland et al. | 431/95 |
| 3,556,699 | 1/1971 | Takahashi et al. | 431/95 |
| 3,602,619 | 8/1971 | Van der Tas et al. | 431/95 |
| 3,627,459 | 12/1971 | Van der Tas et al. | 431/95 |
| 3,724,991 | 4/1973 | Schupp | 431/95 |
| 3,823,994 | 7/1974 | De Graaf et al. | 431/95 |

*Primary Examiner*—Carroll B. Dority, Jr.
*Attorney, Agent, or Firm*—John F. McDevitt; Lawrence R. Kempton; Frank L. Neuhauser

[57] ABSTRACT

An improved primer material is disclosed for a high-voltage type flashlamp construction. Said primer material comprises a solid mixture of a combustible fuel and an oxidizer for the fuel such as alkali metal chlorates and perchlorates, and which further contains a combustion-supporting oxide of the type which is converted to a lower oxide upon combustion of the mixture. An all glass flashlamp construction is disclosed in which the improved primer material can be disposed between a pair of spaced apart inlead wires to provide suitable ignition means for the combustion of a quantity of filamentary combustible material distributed within the lamp envelope.

17 Claims, 4 Drawing Figures

Fig. 1
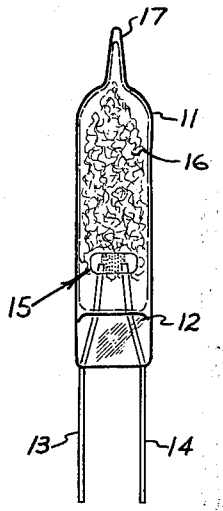
Fig. 2
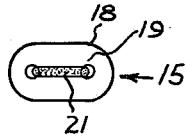
Fig. 3
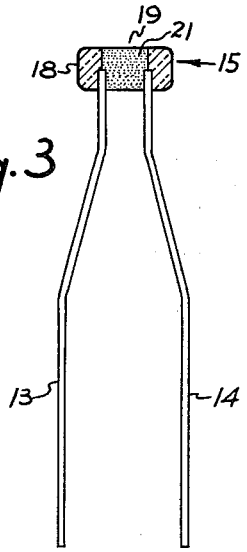
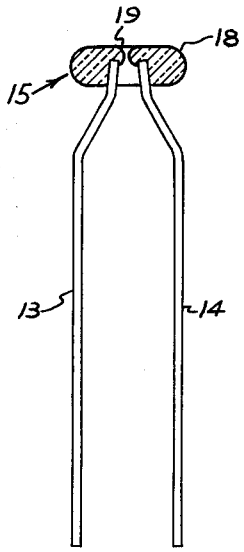
Fig. 4

PHOTOFLASH LAMP

CROSS-REFERENCE TO RELATED APPLICATION

A flashlamp which can be of the all glass type that is actuated by a high voltage pulse is described in U.S. patent application Ser. No. 453,487, filed Mar. 21, 1974 in the name of John C. Sobieski, entitled "Flashlamp Mount Construction" and assigned to the assignee of the present invention, this application having issued on May 20, 1975, as U.S. Pat. No. 3,884,615.

BACKGROUND OF THE INVENTION

This invention is in the field of photoflash lamps of the so-called high-voltage type, which contain a primer material connected across inlead wires, there being no conventional filament in such a lamp. These lamps further contain a hermetically sealed light-transmitting envelope made of the glass at the present time along with a combustion-supporting gas such as oxygen together with a loosely distributed filling of a suitable light-producing combustible material such as shredded foil of zirconium, aluminum or hafnium, for example, which upon ignition produces a high intensity flash of actinic light.

Electrically actuated photoflash lamps may be classified generally into two voltage types: low-voltage and high-voltage. The low voltage types usually are intended to be flashed by a battery, or a charged capacitor, having a voltage of about 1.5 volts to 15 volts, whereas the high-voltage flashlamps are intended to be flashed by a firing pulse of a few hundred volts or greater such as can be produced by striking a piezoelectric material. Conventional low-voltage flashlamps contain a filament connected across inlead wires. When the filament is heated by a firing current, it ignites a primer material which in turn ignites a combustible material such as metal foil which, with the aid of oxygen in the lamp, produces a flash of light.

In typical high-voltage flashlamp constructions, the primer material is connected directly across and between a pair of inlead wires extending into the lamp envelope. The primer material may be positioned and carried in the lamp on top of a glass or ceramic insulating member through which the inlead wires extend, or may be carried in a cavity in such a member. In another construction, the primer material is carried on or in a depression in the inner wall of the envelope at the bottom of the lamp. In another high-voltage flashlamp construction, disclosed in U.S. Pat. Nos. 2,868,003 and 3,000,200, both to Warren Albrecht, the primer material is applied to one or both of the inlead wires within the lamp and the electrical circuit is completed through the combustible shredded metal foil in the lamp.

Various primer materials suitable for the ignition means in the above type lamp constructions are known. The known primer materials generally consist of a solid mixture of a readily combustible fuel such as phosphorous with an oxidizer compound for the fuel such as alkali metal and alkaline earth metal chlorates, as well as perchlorates including sodium perchlorate, potassium perchlorate, barium chlorate, sodium chlorate, and potassium chlorate. The fuel in the primer material is generally a powdered combustible incandescible metal such as zirconium, hafnium, thorium, aluminum, magnesium, boron, silicon or their alloys which upon actuation by a high voltage pulse ignite the filamentary combustible material. The known primer materials are generally prepared as liquid suspensions in an organic or aqueous solvent to provide an adherent mass of the primer material between the spaced apart inleads. A known organic liquid suspension for the primer material, that is, described in U.S. Pat. No. 2,972,937 to C. G. Suits, utilizes nitrocellulose as the binder agent and it requires careful handling during storage and lamp manufacture to avoid accidental ignition. A less sensitive aqueous suspension of the primer material utilizing the conventional ignition mixture employs hydroxyethylcellulose or methoxycellulose, polyvinyl pyrrolidone as water-soluble binder agents.

A number of considerations are important for the primer material to reliably ignite the combustible material in a high-voltage flashlamp of the type above generally described so that the desired light output is obtained in a relatively short time period. More particularly, the primer material must be sensitive enough in oxygen or another combustion-supporting gas to reliably ignite the principal filamentary combustible material distributed within the lamp glass envelope with a blast of sparks in order for the principal combustion reaction to take place whereby the light output from the lamp is produced at a desired light level and time span. If the blast velocity of the primer material is excessive, then the filamentary combustible material becomes packed in the lamp envelope with subsequent reduction/in light output or slower burning rate. In certain high-voltage lamp constructions intended for use in the multilamp photoflash array where each individual lamp desirably provides an "open circuit" to successive high-voltage pulses after flashing, it is also important that the blast characteristics of the primer material as well as the principal combustion reaction not produce a significantly low resistance short between the spaced apart inleads of the lamp. A still further important operating characteristic of the primer material in a high-voltage flashlamp is the voltage at which the primer's electrical resistance breaks down or decreases thus allowing sufficient energy to be transferred from the firing pulse at its available voltage level to cause primer ignition. Said in another way, excessive variation in this breakdown voltage characteristic could lead to a failure of the lamp to flash or to flash an inferior light output. The conventional primer mixtures have been found not to reliably provide proper ignition in a high-voltage type flashlamp which can be attributed at least in part to incomplete combustion of the combustible fuel constituent in the primer material. While excess stoichiometric amounts of the oxidizing constituent for said combustible fuel can be employed as a means to provide a complete fuel combustion, such compensation leads to producing a general oversensitivity in the primer material accompanied by an overly vigorous blast characteristic.

SUMMARY OF THE INVENTION

It has now been discovered that certain metal oxide additives in the solid primer mixture promote a more complete combustion of the primer fuel. These combustion-supporting oxides have also been found not to have a detrimental effect when contained in the solid primer mixture in amounts up to 50 weight percent or greater by weight of said solid mixture in the preferred primer compositions hereinafter described and further dependent upon a number of other lamp design characteristics such as lead spacing and desired breakdown voltage. The particular oxides having this beneficial effect are binary and tenary metal compounds which are converted to a lower oxide form upon combustion of the primer mixture and filament material in a high voltage flashlamp responsive to the high voltage energy pulse. In a preferred flashlamp construction of the open circuit type it is essential to select the combustion supporting oxide which does not readily convert to a conductive state such as a lower conductive oxide or metallic state imparting increased electrical conductivity to the post ignition primer residue since this can lead to enhanced conduction between the inleads after the primer has been ignited.

While the exact mechanism whereby the present combustion supporting oxide additives provide an improved primer material for a high voltage activated flashlamp is not fully understood at present, it is believed that the additive is partially reduced through chemical reaction taking place when the lamp is flashed to provide a source of oxygen which is readily available for combustion of the primer fuel by reason of the oxygen being generated in the solid mixture. Thermodynamic calculations conducted for a preferred primer material composition having powdered zirconium as the combustible fuel and sodium chlorate as the oxidizer for said fuel have shown that particular combustion supporting oxides such as $Co_3O_4$ and $BaCrO_4$ can be easily reduced by zirconium or some other reducing agent in the primer mixture to lower non-conducting oxides having sufficient stability to resist further disassociation into conducting residues at the operating conditions of existing lamp designs. According to the above generally defined mechanism as pertains to the example given, the $Co_3O_4$ additive converts to CoO while the $BaCrO_4$ additive disassociates into its BaO and $Cr_2O_3$ constituents. Further experimental verification of these thermodynamic calculations have identified useful combustion supporting oxides for the aforementioned preferred primer material to be selectable from the group consisting of $Co_3O_4$, $BaCrO_4$, $Fe_2O_3$, and higher oxides of nickel by reason of not converting to form a conductive residue when the primer is ignited. In contrast thereto, other metal oxides which are reducible by zirconium upon primer ignition including CuO, PbO, $SnO_2$, $TiO_2$ and ZnO form conductive residues which are unsatisfactory for use in the open circuit lamp design even though such oxides can be decomposed in situ to provide a supplemental oxygen source by the conversion mechanism previously described. A still different group of metal oxides which include $CeO_2$, $ThO_2$and $ZrO_2Al_2O_3$ can produce stable non-conductive lower oxides based on thermodynamic free energy considerations but do not readily convert to these lower oxides at the present lamp operating conditions thus making them less preferable in use for the illustrated primer material. A still further important consideration for the proper selection of a particular combustion supporting oxide with respect to a given material useful in a high-voltage type flashlamp is the relative stability or inertness of the oxide itself so as not to prematurely react in a primer mixture. More particularly, such oxides as $MnO_2$, potassium permanganates, dichromates and perchromates have been found objectionable in certain primer mixtures although exhibiting desirable thermodynamic free-energy characteristics. The greater oxidizing nature of these oxides at ambient conditions has resulted in premature oxidation of the adhesive binder in the primer mixture.

BRIEF DESCRIPTION OF THE DRAWINGS

FIG. 1 is a front elevation view of a flashlamp of the invention.

FIG. 2 is a top view of the mount member in the flashlamp of FIG. 1.

FIG. 3 is a side cross-sectional view of the mount member in FIG. 1.

FIG. 4 is a side cross-sectional view of a different mount member of the invention.

DESCRIPTION OF THE PREFERRED EMBODIMENTS

In a preferred flashlamp design of the present invention, a mount construction is employed for assembly of the inlead wires and primer material. Said flashlamp mount construction is fully described in the aforementioned patent application Ser. No. 453,487 (now U.S. Pat. No. 3,884,615) and comprises a glass bead or other electrically insulated member provided over an end of the pair of inlead wires. An opening is provided to the bead member between and in communication with both of the inlead wires, and primer material is provided in the opening and electrically bridges across the inlead wires. Preferably the aforesaid opening extends fully through the bead member in a direction parallel to the inlead wires. Also, preferably, a portion of the bead member extends above and overlies at least a portion of the ends of the inlead wires. One of the inlead wires may extend through the top of the bead member for contact with the filamentary combustible material in the lamp. The underside of the bead member may be sleeved or shaped to provide increased electrical insulation at the inlead wires to prevent shorting between them.

The above-described preferred lamp construction is shown in FIG. 1 as having the same general features except for the mount construction as described in FIG. 5 of U.S. Pat. No. 3,506,385 to Kurt Weber and George Cressman, which comprises a tubular envelope 11 preferably made of a borosilicate glass or other suitable light-transmitting vitreous material such as lead glass and having a stem press seal 12 at one end thereof through which a pair of inlead wires 13 and 14 extend from the exterior to the interior of the bulb 11 in a generally mutually parallel spaced apart manner and form part of a mount 15. The bulb 11 is partially filled, above the mount 15, with a loose mass of filamentary or shredded metal wire or foil 16, of zirconium or hafnium, or other suitable combustible metal. Air is exhausted from the bulb 11, and the bulb is filled with oxygen at a pressure of at least several atmospheres, such as about 5 to 10 atmospheres or greater and the bulb is sealed off at an exhaust tip 17 at the other end thereof from the stem press seal 12. The lamp may be coated with the usual lacquer or plastic protective coating.

As further shown in FIGS. 2 and 3, the mount 15 includes flash ignition means for igniting the combustible material 16 comprising a glass bead or other vitreous electrically insulative member 18 sealed over and around an end of the pair of lead-in or inlead wires 13, 14. An opening 19 is provided to the bead 18 and is between and in communication with both of the inlead wires 13 and 14. The bead 18 may be formed by placing a ring of glass around the ends of the inlead wires, and heating for a suitable time and a suitable temperature so as to cause the glass ring to shrink into molten contact with the end portions of the inlead wires, leaving a slot-like or other shaped opening 19. Greater accuracy can be achieved by molding the glass ring in place or into place. The ends of the inlead wires 13 and 14 extend only partially into the bead, as shown, and the bead material overlies the ends of the inlead wires. The opening 19 is at least partially filled with a solid mixture of primer material 21. Improved primer materials according to the present invention can be applied as a liquid coating or dispersion which is subsequently dried during lamp manufacture to provide a mass of adhesively bonded material across the inleads.

In a modified mount construction as shown in FIG. 4, the opening 19 is tapered with the larger end being oriented closer to the seal portion 12 of the lamp. By having a larger opening at the opposite end of the opening from the filamentary combustible material the debris resulting from ignition of the primer material is helped to blast toward the base of the lamp during ignition and out of the opening 19 to reduce the amount of residue in the opening after flashing which could increase the after flash electrical conduction across the lead-in wires 13 and 14 while at the same time a sufficient amount of primer blast and sparks are directed upwardly from the opening 19 so as to reach and ignite the filamentary combustible material 16 when the lamp is flashed. A still further modification of the above-described mount construction (not shown) can have one lead-in wire extend completely through the bead 18 so as to be in electrical contact with the combustible material 16 which provides electrical grounding of said combustible material so as to reduce the possibility of accidental electrostatic flashing of the lamp.

As indicated in the above preferred embodiment, a liquid coating composition of the primer material can be deposited to the opening 19 in the mount construction by various means such as with a syringe, or by daubing, or by dipping the inverted mount member in the liquid primer mixture. The small cross-sectional area of the opening 19 and the opening being open at both ends, causes a capillary action effect which aids in drawing the liquid primer material into the opening. The binder and liquid medium are then dried out from the primer material 21 in the opening 19. The coated mount 15 can thereafter be sealed in the envelope 11 prior to putting the primer 21 into the opening 19 of the bead 18, and then the filamentary combustible material 16 is positioned in the envelope above the bead 18 whereby the upper end of the opening 19 is directed toward the combustible material 16, the tipped-off end 17 is necked down, the bulb is evacuated and filled in with oxygen, and then tipped off at 17.

An example of a stabilized coating composition made in accordance with the present invention which is both safe to handle by reason of being an aqueous dispersion and also exhibits the desired sensitivity in lamp operation is as follows:

| Ingredients | Parts by Weight |
|---|---|
| Zirconium powder | 10 parts |
| Barium chromate | 3 parts |
| Sodium chlorate | 1 part |
| Polyvinyl Pyrrolidone Binder | 0.2 parts |
| Water | 4–10 parts |

This primer suspension can be mixed in a conventional manner to produce a smooth, even blend of the constituents which is stable in storage over reasonably long time periods. All solid materials except the sodium chlorate can have a particle range from a fine mesh size to a sub micron size which insures a smooth and uniform primer coating. By having the sodium chlorate oxidizer dissolved rather than simply dispersed in the coating composition, additional safety in handling the liquid mixture is obtained.

As especially preferred primer material of the present invention contains a mixture of $Co_3O_4$ and barium chromate $BaCrO_4$ as the combustion-supporting oxide constituent which has been found to provide a primer that is both sufficiently ignition sensitive and does not result in forming a conductive residue after ignition. Such preferred primer material composition comprises a solid mixture in percentages by weight 46.1% zirconium, 14.5% sodium chlorate, 31.7% $Co_3O_4$, and 7.7% $BaCrO_4$ which further contains between 1–5% of a water-soluble polymer binder such as polyvinyl alcohol or polyvinyl pyrrolidone. By changing the weight ratio of the active zirconium, sodium chlorate, $Co_3O_4$ and $BaCrO_4$ constituents in the primer, it is possible to make the final primer more or less explosive and more or less sensitive in air or oxygen as well as alter the breakdown voltage. The formulation can be varied to make the liquid coating composition safer to handle wet or dry and still be made sensitive enough in oxygen or some other combustion-supporting gas to reliably ignite the flashlamp upon application of the high voltage pulse. Consequently, the proper balance between safety and sensitivity will specify the particular formulation best fitted for a given example.

While the best mode of carrying out the present invention has been set forth above, it will be understood that additions, changes and modifications may be made thereto without departing from the spirit and scope of the invention as defined in the appended claims. For example, it will be apparent that extenders such as finely divided silica or alumina and suspending agents can be added to the aqueous slurry for greater stability if the need arises. Likewise, defoamers can be added to an aqueous slurry which may facilitate more immediate application of a freshly prepared coating composition. It is intended to limit the present invention therefore only to the scope of the following claims.

What I claim and desire to secure by Letters Patent of the United States is:

1. Ignition primer means for a high-voltage activated flashlamp which includes, a solid mass of a mixture of powdered zirconium, a polymer binder, an oxidizer for said combustible fuel selected from an alkali metal chlorate or perchlorate compound, and a combustion-supporting oxide-selected from $CO_3O_4$, $BaCrO_4$, $Fe_2O_3$, and the higher oxides of nickel.

2. Ignition primer means as in claim 1 wherein the combustion-supporting oxide is present in sufficient amounts to lower the electrical conductivity of the primer residue.

3. Ignition primer means as in claim 1 wherein the oxidizer includes an alkali metal chlorate compound.

4. Ignition primer means as in claim 1 wherein the combustion-supporting oxide compriss a mixture of $Co_3O_4$ and $BaCrO_4$.

5. Ignition primer means as in claim 4 which comprises a mixture containing in percentages by weight 46.1% zirconium, 19.5% sodium chlorate, 31.7% $Co_3O_4$, and 7.7% $BaCrO_4$.

6. A coating composition to produce a dried solid mass serving as the ignition primer means for a high-voltage activated flashlamp which comprises an aqueous dispersion of a water-soluble polymer binder having an oxidizer dissolved therein selected from an alkali metal chlorate or perchlorate compound and a powdered mixture of zirconium metal and a combustion-supporting oxide being suspended in the aqueous dispersion, said combustion supporting oxide being selected from $Co_3O_4$, $BaCrO_4$, $Fe_2O_3$, and the higher oxides of nickel.

7. A primer coating composition as in claim 6 wherein the polymer binder is selected from the group consisting of polyvinyl alcohol and polyvinyl pyrrolidone.

8. A primer coating composition as in claim 7 which comprises a mixture in percentages by weight 46.1% zirconium, 14.5% sodium chlorate, 31.7% $Co_3O_4$, 7.7% $BaCrO_4$, dispersed in a polyvinyl alcohol solution.

9. A high voltage activated flashlamp comprising a hermetically sealed light-transmitting envelope, a quantity of filamentary combustible material distributed within said envelope, and flash ignition means within said envelope, said flash ignition means including a pair of spaced apart inleads and further including a mass of primer material connected between said inleads, said flashlamp being characterized by said primer material comprising a solid mixture of powdered zirconium, a polymer binder, an oxidizer for said fuel selected from an alkali metal chlorate or perchlorate compound and a combustion-supporting oxide which is selected from $CO_3O_4$, $BaCrO_4$, $FeO_3$, and the higher oxides of nickel.

10. A high voltage activated flashlamp as in claim 9 wherein said primer material is adhesively bonded together with a water soluable binder.

11. A high voltage activated flashlamp as in claim 10 wherein the combustion-supporting oxide comprises a mixture of $Co_3O_4$ and $BaCrO_4$.

12. A high voltage activated flashlamp comprising a hermetically sealed light-transmitting envelope, a quantity of filamentary combustible material distributed within said envelope, and flash ignition means within said envelope, said flash ignition means including a pair of spaced apart inleads and further including a mass of primer material connected electrically to said inleads, said flashlamp being characterized by said primer material comprising a solid mixture of a powdered zirconium, a polymer binder, an oxidizer for said fuel selected from an alkali metal chlorate or perchlorate compound, and a member selected from the group consisting of $Co_3O_4$, $BaCrO_4$, $Fe_2O_3$ and the higher oxides of nickel.

13. A high voltage activated flashlamp as in claim 12 in which said member comprises a mixture of $Co_3O_4$ and $BaCrO_4$.

14. A high voltage activated flashlamp as in claim 13 in which said oxidizer is $NaClO_3$, said mixture containing in percentages by weight approximately 45% zirconium approximately 15% $NaClO_3$, approximately 3.% $Co_3O_4$ and approximately 10% $BaCrO_4$ bonded together by a binder.

15. A high voltage activated flashlamp comprising a hermetically sealed light-transmitting envelope, a quantity of filamentary combustible material distributed within said envelope, and flash ignition means within said envelope, said flash ignition means including a pair of spaced apart inleads and further including a mass of primer material connected electrically to said inleads, said flashlamp being characterized by said primer material comprising a solid mixture of powdered zirconium, $NaClO_3$, $Co_3O_4$ and $BaCrO_4$ bonded together by a polymer binder.

16. A high voltage activated flashlamp as in claim 15 in which said mixture contains in percentages by weight approximately 45% zirconium, approximately 15% $NaClO_3$, approximately 30% $Co_3O_4$ and approximately 10% $BaCrO_4$ and in which said binder is a member selected from the group consisting of polyvinylpyrrolidone and polyvinyl alcohol.

17. A high voltage activated flashlamp as in claim 16 in which said member is polyvinylpyrrolidone.

* * * * *